US010580250B2

(12) United States Patent
Loose et al.

(10) Patent No.: US 10,580,250 B2
(45) Date of Patent: Mar. 3, 2020

(54) SYSTEM AND METHOD FOR SELECTIVE POWER AND SECURE COMMUNICATIONS VIA AN ELECTRONIC GAMING MACHINE INTERFACE

(71) Applicant: BALLY GAMING, INC., Las Vegas, NV (US)

(72) Inventors: Timothy C. Loose, Chicago, IL (US); Walter E. Smolucha, Melrose Park, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 551 days.

(21) Appl. No.: 14/856,058

(22) Filed: Sep. 16, 2015

(65) Prior Publication Data

US 2016/0180656 A1 Jun. 23, 2016

Related U.S. Application Data

(60) Provisional application No. 62/137,359, filed on Mar. 24, 2015, provisional application No. 62/093,719, filed on Dec. 18, 2014.

(51) Int. Cl.
*G07F 17/32* (2006.01)
*G07F 17/34* (2006.01)

(52) U.S. Cl.
CPC ..... *G07F 17/3209* (2013.01); *G07F 17/3223* (2013.01); *G07F 17/3225* (2013.01); *G07F 17/3241* (2013.01)

(58) Field of Classification Search
CPC ..... G07F 17/3209; G07F 17/3225; G07F 17/3223; G07F 17/3241; G07F 15/003;
(Continued)

(56) References Cited

U.S. PATENT DOCUMENTS 6,645,078 B1 * 11/2003 Mattice ..... G07F 17/32 273/138.1
6,661,648 B2 12/2003 Dayley ..... 361/683
(Continued)

FOREIGN PATENT DOCUMENTS

EP 1693806 A1 8/2006 ..... G07F 17/32
WO WO 2004/075129 A1 1/2004 ..... G07F 17/32

*Primary Examiner* — David L Lewis
*Assistant Examiner* — Matthew D Hoel
(74) *Attorney, Agent, or Firm* — Grant A. Dingledine

(57) ABSTRACT

A gaming system includes a secure communication board having a Universal Serial Bus (USB) interface and/or a wireless interface accessible externally to players and administrators of the gaming system. The secure communication board selectively provides power and communication between a coupled or proximate mobile device and the gaming system. The secure communication board includes a microcontroller to selectively control both power and communication flow through the secure communication board to the external interfaces. The microcontroller is responsive to the physical state of gaming system components and gaming system processor events and control signals. A wagering game event, user authentication, and/or specific states of one or more physical security switches of the gaming system may be required to provide power and data via the external interfaces.

19 Claims, 9 Drawing Sheets

(58) Field of Classification Search
CPC ..... G07F 15/006; G07F 15/12; G06Q 50/06; G06Q 50/10; G06Q 50/12; G06Q 50/34; G01R 11/00
See application file for complete search history.

(56) References Cited

U.S. PATENT DOCUMENTS 6,804,763 B1 * 10/2004 Stockdale ..... G07F 17/3241 463/24
6,811,486 B1 * 11/2004 Luciano, Jr. ..... G07F 17/3239 273/459
6,870,089 B1 * 3/2005 Gray ..... H01L 31/042 136/200
6,899,627 B2 5/2005 Lam et al. ..... 463/40
6,997,803 B2 * 2/2006 LeMay ..... G07F 17/32 463/20
7,278,917 B2 9/2007 McGlone et al. ..... 463/20
7,680,973 B2 * 3/2010 Goldstein ..... G06F 13/24 320/145
7,819,750 B2 10/2010 Lam et al. ..... 463/43
8,057,303 B2 * 11/2011 Rasmussen ..... G07F 17/3202 463/16
8,298,085 B2 10/2012 Bond ..... 463/42
8,764,572 B2 7/2014 Nguyen et al. ..... 463/44
8,845,433 B2 9/2014 Nelson et al. ..... 463/42
9,483,901 B2 * 11/2016 Nguyen ..... G07F 17/3241
9,576,425 B2 * 2/2017 Nguyen ..... G07F 17/3241
9,811,973 B2 * 11/2017 Nguyen ..... G07F 17/3241
9,852,578 B2 * 12/2017 Nelson ..... G07F 17/3241
9,875,607 B2 * 1/2018 Nelson ..... G07F 17/3241
10,230,257 B1 * 3/2019 Dawson, III ..... H02J 7/025
2002/0089820 A1 7/2002 Abboud ..... 361/685
2003/0023540 A2 * 1/2003 Johnson ..... G06Q 10/04 705/37
2003/0064805 A1 * 4/2003 Wells ..... G07F 17/32 463/39
2003/0224854 A1 * 12/2003 Joao ..... G07F 17/32 463/40
2003/0226042 A1 * 12/2003 Fukushima ..... G06Q 20/04 726/28
2004/0080905 A1 4/2004 Frank ..... 361/683
2004/0082385 A1 * 4/2004 Silva ..... G07F 17/0014 463/40
2004/0254006 A1 12/2004 Lam et al. ..... 463/16
2004/0254013 A1 12/2004 Quaishi et al. ..... 463/29
2004/0254014 A1 12/2004 Quaishi et al. ..... 463/29
2005/0101383 A1 * 5/2005 Wells ..... G07F 17/32 463/39
2005/0130728 A1 * 6/2005 Nguyen ..... G07F 17/32 463/16
2005/0172062 A1 8/2005 Adams ..... 710/305
2006/0189382 A1 * 8/2006 Muir ..... G07F 17/32 463/29
2007/0058332 A1 3/2007 Canterbury et al. ..... 361/683
2008/0299833 A1 12/2008 Abe ..... 439/660
2009/0017914 A1 1/2009 Velu ..... 463/40
2010/0261529 A1 * 10/2010 Bleich ..... G07F 17/32 463/36
2010/0306027 A1 * 12/2010 Haugh ..... G06Q 10/04 705/7.36
2010/0327644 A1 * 12/2010 Lamparter ..... B60N 2/686 297/354.1
2011/0078092 A1 * 3/2011 Kim ..... B60L 50/66 705/412
2012/0296794 A1 * 11/2012 Boot ..... G06Q 10/02 705/37
2013/0137509 A1 * 5/2013 Weber ..... G07F 17/3209 463/29
2014/0051522 A1 2/2014 Robb ..... 463/42
2014/0162768 A1 * 6/2014 Nelson ..... G07F 17/32 463/25
2014/0274309 A1 * 9/2014 Nguyen ..... G07F 17/3241 463/25
2016/0027249 A1 * 1/2016 Nelson ..... G07F 17/32 463/29
2016/0180656 A1 * 6/2016 Loose ..... G07F 17/3209 463/20
2017/0011589 A1 * 1/2017 Nguyen ..... G07F 17/3241
2017/0169657 A1 * 6/2017 Keilwert ..... G07F 17/3225
2018/0053378 A1 * 2/2018 Nguyen ..... G07F 17/3241

* cited by examiner

SYSTEM AND METHOD FOR SELECTIVE POWER AND SECURE COMMUNICATIONS VIA AN ELECTRONIC GAMING MACHINE INTERFACE

RELATED APPLICATIONS

This patent application claims the priority benefit of U.S. Provisional Patent Application Ser. No. 62/093,719, filed Dec. 18, 2014 and entitled "SYSTEM AND METHOD FOR SELECTIVE POWER AND SECURE COMMUNICATIONS VIA AN ELECTRONIC GAMING MACHINE INTERFACE", and U.S. Provisional Patent Application Ser. No. 62/137,359, filed Mar. 24, 2015 and entitled "SYSTEM AND METHOD FOR SELECTIVE POWER AND SECURE COMMUNICATIONS VIA AN ELECTRONIC GAMING MACHINE INTERFACE", both incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to an electronic gaming machine (EGM) having components providing the selective delivery of power to portable devices via an external power interface for charging portable devices. One such interface includes a universal serial bus (USB) interface. Additionally, the present invention relates to components of an EGM providing selective and secure data communication between an external communications interface and one or more components of the EGM. Communication security may be realized, for example, by requiring a specific state for one or more security switches of the EGM, and/or successful authentication of a user using a biometric or input authentication device.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines, and those machines with features and services which are desirable.

In today's casino environment, most players carry at least one mobile device with them during their gaming sessions. As with all electronics, the batteries in these devices will drain over the course of their gaming session and if the operation of their mobile device(s) ceases, a player may be inclined to prematurely end their gaming session. This will result in a reduction in revenue to the operating casino, and therefore it is desirable to provide a feature to alleviate this concern.

SUMMARY OF THE INVENTION

According to one aspect of the present invention, a gaming system is described that is primarily dedicated to playing at least one regulated casino wagering game. The gaming system includes a secure gaming cabinet for housing components associated with the casino wagering game, an electronic display device coupled to the gaming cabinet, an electronic input device coupled to the gaming cabinet, the electronic input device configured to receive a physical input from a player indicative of a wager to initiate the casino wagering game and transform the input into an electronic data signal, a random element generator configured to generate one or more random elements, a power supply, and a mobile device interface coupled to the power supply. The mobile device interface is configured to couple with a mobile device in proximity to the gaming machine, selectively provide power and data communication to the mobile device based on a power control signal and a data control signal, respectively. The gaming system further has game-logic circuitry configured to initiate the casino wagering game in response to the electronic data signal from the electronic input device, determine an outcome of the casino wagering game based, at least in part, on the one or more random elements, and grant a tangible award in response to the outcome meeting a predetermined award criterion. Additionally, in response to an event associated with the casino wagering game satisfying predetermined criteria, the power control signal is generated, and in response to one or more detected states of the gaming system satisfying predetermined criteria, the data control signal is generated.

According to another aspect of the invention, a casino gaming machine primarily dedicated to playing at least one regulated casino wagering game is described. The gaming machine includes a secure gaming cabinet for housing components associated with the casino wagering game, an electronic display device coupled to the gaming cabinet, an electronic input device coupled to the gaming cabinet, the electronic input device configured to receive a physical input from a player to initiate the casino wagering game and transform the input into an electronic data signal, and a power supply. A mobile device interface is disposed as part of the gaming cabinet, coupled to the power supply. The mobile device interface is configured to couple with a mobile device in proximity to the gaming cabinet and selectively provide power to the mobile device in response to an event associated with the casino wagering game. Game-logic circuitry is disposed within the gaming cabinet including a random element generator, the random element generator configured to generate one or more random elements. The game-logic circuitry is configured to initiate the casino wagering game in response to the electronic data signal from the electronic input device, determine an outcome of the casino wagering game based, at least in part, on the one or more random elements, direct the electronic display device to display the outcome, and grant a tangible award in response to the outcome meeting a predetermined award criterion. The game-logic is also configured to provide power from the power supply of the gaming system to the mobile device via the mobile device interface in response to detecting the event satisfying predetermined criteria.

According to another aspect of the invention, a secure communication board coupling to one or more mobile device interfaces and a gaming system performing a wagering game is disclosed. The secure communication board includes a host interface coupling the secure communication board to the gaming system, a device interface coupling the secure communication board to the one or more mobile device interfaces, a power switch receiving power from a power supply of the gaming machine and receiving a power control signal, the power switch configured to selectively provide power to at least one of the one or more mobile device interfaces based on the power control signal, and one or more microcontrollers coupling the host interface to the device interface. The one or more microcontrollers are configured for receiving a data control signal, and selectively allow data communication between the gaming system and the at least one of the one or more mobile device interfaces based on the data control signal.

Additional aspects of the invention will be apparent to those of ordinary skill in the art in view of the detailed description of various embodiments, which is made with reference to the drawings, a brief description of which is provided below.

Figure 1:
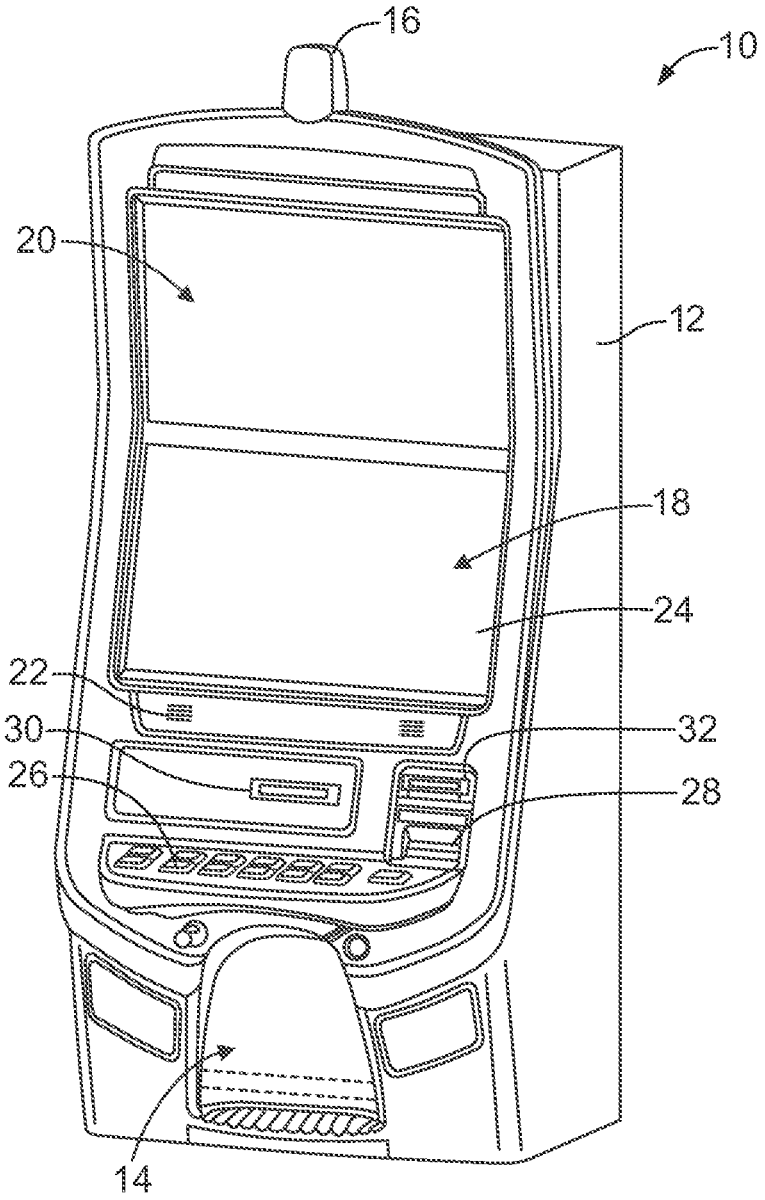
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
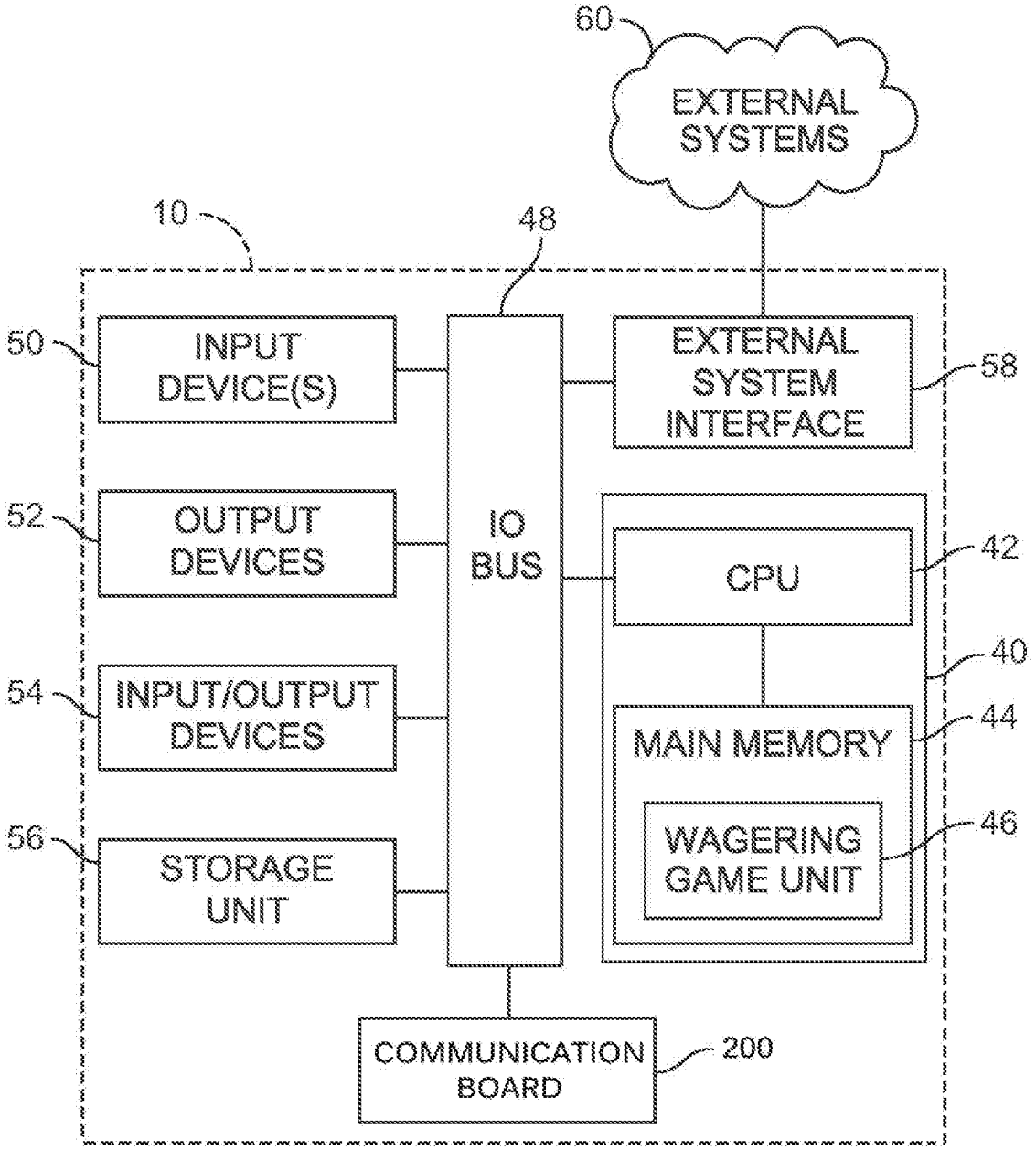
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

In one embodiment, the present invention includes circuitry realized on a modular communication board 200 that connects to the game-logic circuitry 40 via bus 48. Circuitry performing decision making may occur within the game-logic circuitry 40 and/or on a component of the communication board 200. The arrangement of the electronic components is arbitrary and may involve distributed or collocated placement or location of circuitry and specific functional components which perform the disclosed methods. Broadly speaking, the invention transcends any particular physical embodiment, and does not require a specific number of physical circuit boards, electronic components, switches, couplings, or interfaces both internal and external. The game-logic circuitry 40 may or may not include a physical port for device connection and everything logically and/or physically in between. In short, any number of collective circuit boards, electrical connections and couplings, functional and processing electrical components, and physical or logical interfaces that enable the transfer of power and data communication are feasible in accordance with the invention as disclosed.

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
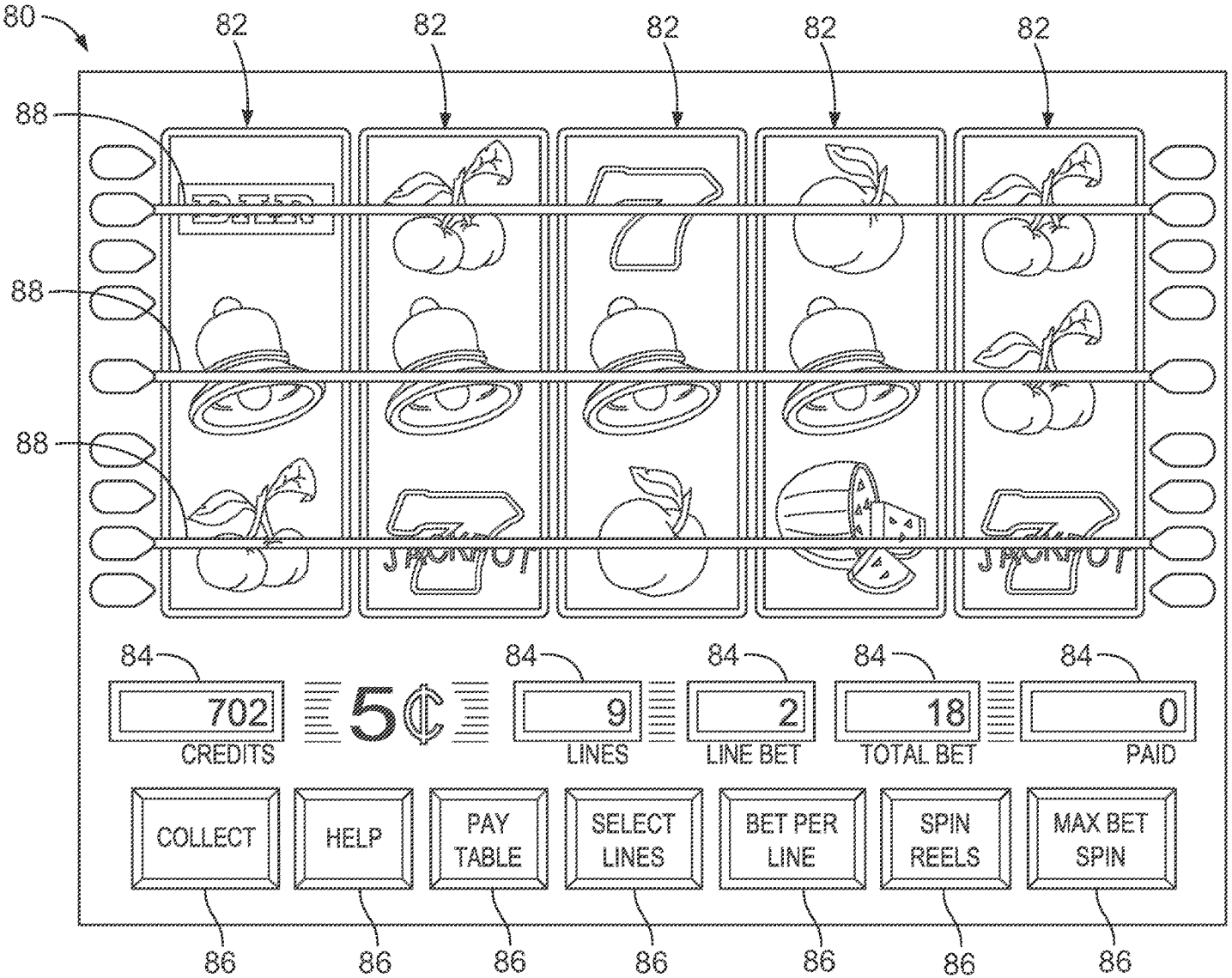
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

In one embodiment, the present invention relates to the use of one or more power and communicative interfaces accessible to a user on an exterior surface of an electronic wagering machine. In some embodiments, an external power interface is exposed at the front of the EGM (i.e., the player position) and is readily accessible by the player (or an administrator) to connect a mobile device to receive power for charging. In another embodiment, an external power interface may be one or more exposed USB receptacles. In another embodiment, an externally accessible power interface is a wireless charging module that can charge mobile devices in a specific proximity.

Figure 4:
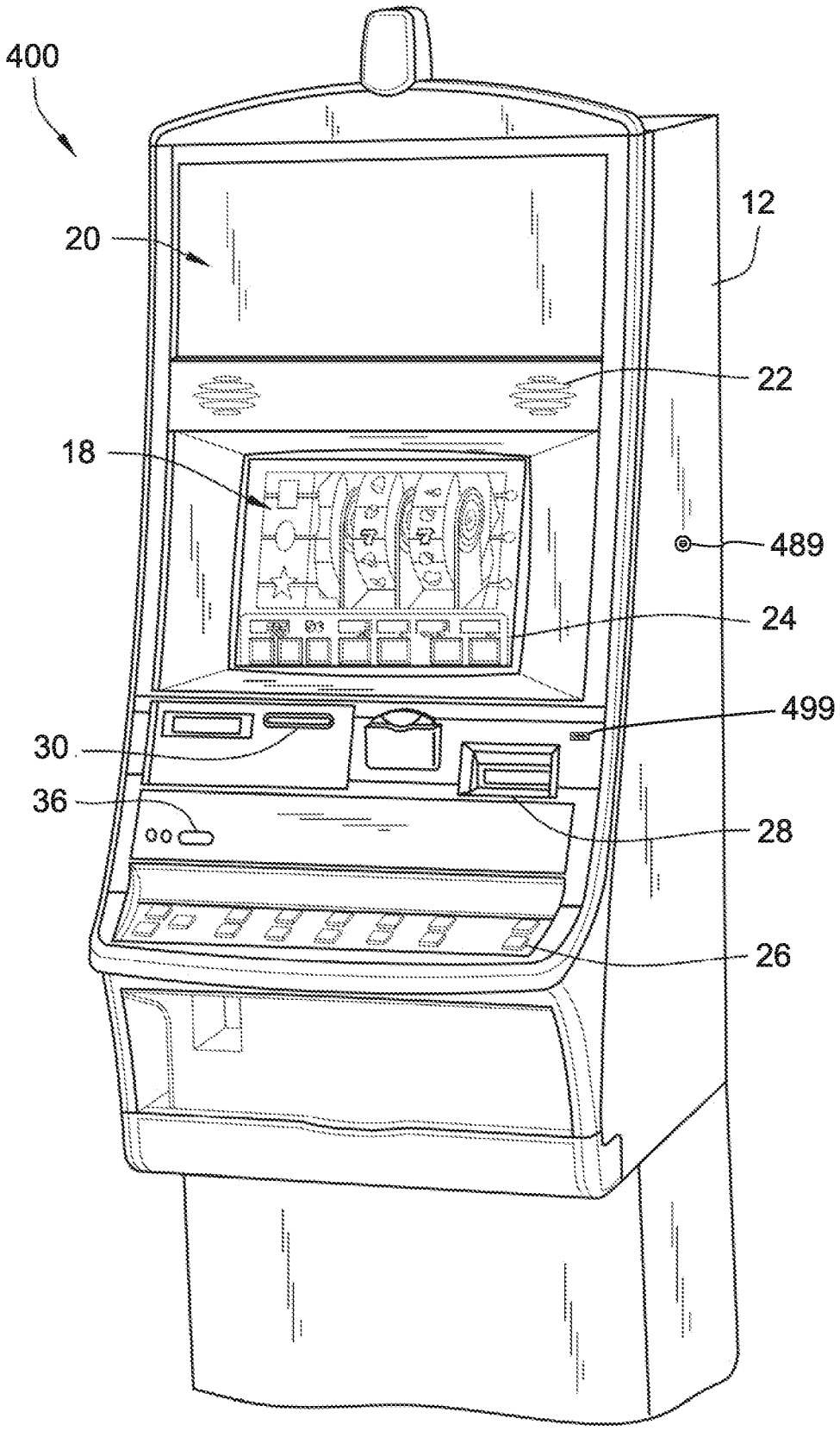
FIG. 4 is a perspective view of a free-standing gaming machine having a security key switch and a USB receptacle facing the player position according to an embodiment of the present invention.

Referring now to FIG. 4, there is shown a gaming machine 400 similar to the gaming machine 10 described in reference to FIG. 1. In this embodiment, the gaming machine 400 comprises a cabinet 12, a primary display area 18, a secondary display area 20, one or more audio speakers 22, one or more touch screens 24 mounted over the primary or secondary areas, buttons 26 on a button panel, a bill/ticket validator/acceptor 28, an information reader/writer(s) 30, a ticket dispenser 32, and player-accessible port(s) 36. Gaming machine 400 also includes a key switch 489 and an externally accessible receptacle 499. Additionally, player-accessible port(s) 36 may include an alternate or additional receptacle 499, in addition to another type of external power and/or data interface as detailed prior. The inclusion of one or more wireless power and/or communication modules (not shown), providing wireless power delivery and/or wireless data transfer, is also contemplated in one embodiment. The inclusion of multiple key switches 489 or varying types of switches is also within the spirit and scope of the invention. Further, one or more receptacles 499 (or other interfaces) may be located at any suitable location of the gaming machine 400 without departing from the overall spirit and scope of the invention.

The key switch 489 may be used to control or alter the operational mode of the receptacle 499. The key switch 489 may or may not be a cabinet lock. In the embodiments where the key switch 489 is not a cabinet lock, activating the key switch 489 does not provide access to the interior of the gaming machine 400. In one embodiment, the key switch 489 is used to directly control the ability for permitting data flow through the receptacle 499. In another embodiment, the state of the key switch 489 is used in combination with command messages (which may include control signals) or authorizations generated by one or more components of the game-logic circuitry 40 to control the operational modes of the receptacle 499 to control the flow of power and/or data through the receptacle 499.

In one embodiment, the present invention also relates to the use of a gaming machine with one or more communication interfaces exposed or accessible at the exterior of the EGM, or alternatively, a wireless communication interface accessible to devices external to the EGM within a specific proximity. A physical external communication interface (such as one or more receptacles 499) is exposed at the front of the EGM (i.e., the player position) and is readily accessible by the player (or an administrator) to connect a mobile device (i.e., a memory device) to communicate with the EGM.

In one embodiment, the external power interface and the external communication interface are dually encompassed by a single receptacle 499, although, any physical interface capable of transferring power and data simultaneously would be suitably equivalent.

The EGM may implement one or several identical or differing interfaces for connecting to external mobile devices. Additionally, there is no requirement that the power interface and data communication interface be envisioned as a single port or receptacle. For instance, a mobile device may have data communication transfer with a gaming machine via a receptacle simultaneously with a wireless or separate connection for power transfer. Further, any type of power and data communication coupling would function in conjunction with the communication board 200 in one or more embodiments. Standards for coupling electronic devices to exchange power and data over a single cable are widely varied, including USB, USB power delivery (USB PD), IEEE 1394 (Firewire), RS232, X10, IEEE 802.3-2012 Power over Ethernet (PoE), Intel™ Thunderbolt, Apple™ 30-pin or Lightning connectors, Samsung™ connectors, Portable Digital Media Interface (PDMI), etc., all of which are compatible, separately or combined, with the operations of the invention.

In one embodiment, a communication board 200 coupling to one or more interfaces facing the player on an EGM may be designed to operate in a number of specific modes. In one embodiment, modes of operation may include provision for power only or provision for simultaneous power and data communication. The power only mode may enable a coupled device (via a cable or wireless proximity) to receive power, but otherwise prohibit data communication in any capacity. In one embodiment, this mode of operation is preferred for typical users (i.e., players) of the EGM, to avoid potential security problems caused by unscrupulous actors. Other users, including administrators and technicians, may require a more functional communicative connection, providing both power and data services through the externally accessible interfaces. Connectivity may include one-way or two-way communication with EGM components, including EGM central processor(s) 42 or game-logic circuitry 40. In one embodiment, the communication board 200 is configured to provide these varying modes of operations in addition to other various levels of data exchange and accessible services based upon an obtained user identity and proper authentication.

The various modes of operation may also be specified in combination with the state of one or more physical security devices of components of the EGM, such as mechanical security locks and other tangibly physical mechanisms. For example, the EGM may require the turn of a security key in a specific key switch 489 located on the exterior of an EGM to initiate a particular mode of operation, while a switch internal to the EGM may be required to initiate another particular mode of operation. A cash lock box located in a secured section of the EGM may engage, prohibit, or enable an additional particular mode of operation when the cash lock box is open or unsecured. For example, the physical security devices may include one or more switches present on the cash lock box, an internal or external panel or door of the EGM chassis, or on the exterior of the EGM. In one embodiment, the opened or closed state of one or more switches may cause the generation of control signals to control power and data communication flow between the EGM and device(s) coupled with any externally accessible interfaces.

The combination of physical security mechanisms to control the mode of operation of the EGM and communication board 200 may additionally include information flow through one or more physical security mechanisms. Alternatively, a control signal may be provided that indicates a specific state to the communication board 200 such that the communication board 200 may permit or engage specific operational modes in response to a set of particular component states. For example, a specific control signal may be generated in response to an externally mounted security key switch being in a particular position. Alternatively, an internal switch mounted to an internal panel or door may be generated in response to detecting the panel or door is closed, causing a list of available operational modes. The generation of these control signals may be used to collectively determine one or more appropriate modes of operation for the communication board 200, and power and communicative interfaces available to users of the EGM.

Additionally, the use of EGM cabinet physical security devices may serve other purposes in addition to controlling or altering operational modes of the communication board 200. For example, a key based switch 489 may be used to enable a technician to enter diagnostic modes, clear faults, etc. Alternatively, the use of one or more key based switches may be specifically required in combination with a communication board 200 to enable a specific type of communication between a user and an EGM using a given available communication interface. As a parallel consequence to using a key based switch 489, a communication board 200 may also enable a technician to use the communication board 200 and a coupled receptacle 499 for power and data communication with various internal components of the EGM, either with or without authentication. Additionally, the system may also provide methods for the technician to digitally authenticate in order to engage specific operational modes and/or communicate with particular internal EGM components.

Components that may directly interface with accessible interfaces (e.g., USB receptacles) of the communication board 200 include a coupling/charging cable (e.g., USB Standard A to Micro B connector), a mass-storage device including non-volatile memory modules (e.g., a flash drive), or a human interaction device (HID) (e.g., a pointing device, like a mouse or joystick). Components that directly interface with wireless power and communication interfaces may include access control key fobs, etc. Other types of devices may also be coupled to the communication board 200 and EGM, including audio devices (e.g., speakers), portable printers, biometric devices (e.g., fingerprint scanners), wireless adaptors, mobile phones or computing devices, etc., using one or more of the externally accessible power and/or communication interfaces.

As stated prior, the provision for USB standard specific interfaces is not critical to the invention; the use of any type of power and/or data interface, either simultaneously or independently, does not depart from the spirit and scope of the invention.

In one embodiment, a single physical connector is used to electronically couple the communication board 200 to the I/O bus 48. The connection to the I/O bus 48 may indirectly connect the communication board 200 to other EGM components, including the game-logic circuitry 40. The connector may be configured to simultaneously provide Inter-Integrated Circuit ($I^2C$) control signals and deliver power using a single physical interface (i.e., a unified connector). In one embodiment, a Programmable Intelligent Computer (PIC) (sometimes called a Peripheral Interface Controller or a Programmable Interface Controller) may include one or more microcontroller units (MCUs) and a standardized architecture for controlling power and data flow between the components of the EGM and the communication board 200.

This includes any parameters, conditions, and programmatic directives that may be employed to control the flow of power and data through the communication board 200.

A PIC enables two-way communication between the communication board 200 and one or more game controller (s) of the game-logic circuitry 40. A PIC module may include read-only memory (ROM) or one or more types of field-programmable erasable programmable read only memory (EPROM/EEPROM) for program code storage, and may be further able to be reprogrammed to dynamically update upon command. The use of PIC MCU controller(s) enables the communication board 200 to include any number or type of input/output (I/O) pins, analog-to-digital and digital-to-analog controller modules, and various communications ports having universal asynchronous receiver/transmitter (UART) components, $I^2C$ components, controller area network (CAN) components, and USB components, to name a few.

In one embodiment, the communication board 200 includes an $I^2C$ interface and a charging circuit implementing a specifically programmed PIC to manage variety of functions and operational modes of the communication board 200 and associated circuitry. That is, the $I^2C$ interface may be extended to a PIC on the communication board 200 and positioned proximal to the charging receptacle, for example, a USB connector. The PIC may exhibit functionality including programmatically triggered On/Off operational modes, detection of over-current to protect devices, components, and couplings from damage, reporting operational states to the operating system (e.g., to display a message to the user on the screen), limiting electrical current delivered to a charging module (e.g., receptacle), detecting the presence/connection/operational integrity of the charging circuit, reporting current health status of the charging circuit and/or coupled device(s), prevention of over-charging device(s), generating messages (sent to a mobile device or directed for display to a user that the device is fully charged or to disconnect the mobile device at the end of play, etc.

The use of a physical coupling cable permits a device to receive electric current from an external interface of the secure communication board 200 to charge or power a handheld device, like a mobile phone, tablet computer, or even a fan, in addition to simultaneously and selectively providing communication exchange. However, while operating in a "power-only" mode, the communication board 200 may provide only power through the cable, without providing or allowing any data communication at all. This may be due to one or both of jurisdictional constraints or design choices. The provision for a power-only mode may enable the EGM equipped with this operational mode to provide power to players of a wagering game actively executing on the EGM. Additionally, power may be provided through the interface(s) in response to events which specifically occur in the wagering game, or as a result of any envisioned combination of wagering game occurrences and physical security mechanism states.

The connection of an external memory module (e.g., a flash drive) into a receptacle of the EGM (e.g., a communication board 200 coupled to the internal boards of an EGM) may occur for a variety of reasons and intentions. Further, the external memory devices may be of various kinds, comprising read-only or non-volatile storage mediums, having any type of physical interface(s). Some external memory devices comprise authorization devices which may include digital fingerprint(s), authorization token(s), or other forms of data available for use as an authentication technique, often combined with knowledge from the holder of the external memory device such that ownership of the device, alone, is not sufficient to gain access to any protected service(s) of the EGM. After device and user authentication, a plurality of levels of access may be defined, such that the communication board 200 may control which options are available to an authorized user trying to request access to one or more gaming services or processors. This may include basic levels of inquiry of stored information of the EGM (e.g., usage and accounting data), intermediate levels of access (e.g., setting parameters for the wagering game during use), as well as more advanced administrative functions (e.g., updating software modules of the EGM).

Other types of devices which may be used to interact with an EGM include user interfacing devices, such as pointing devices or mobile display devices. For example, an EGM that does not specifically require a touch screen may include a small portable touch screen display device to enable a technician to use a special graphical user interface to set or modify parameters for the EGM and/or update EGM software or firmware. Further, the ability to connect a pointing device, like a computer mouse, allows the cost of manufacture of the EGM to be significantly reduced. It may also be possible to combine a pointing device with the other types of external compatible modules and devices detailed for use with an EGM, for example, rechargeable or authenticating (and optionally wireless) pointing devices.

Figure 5:
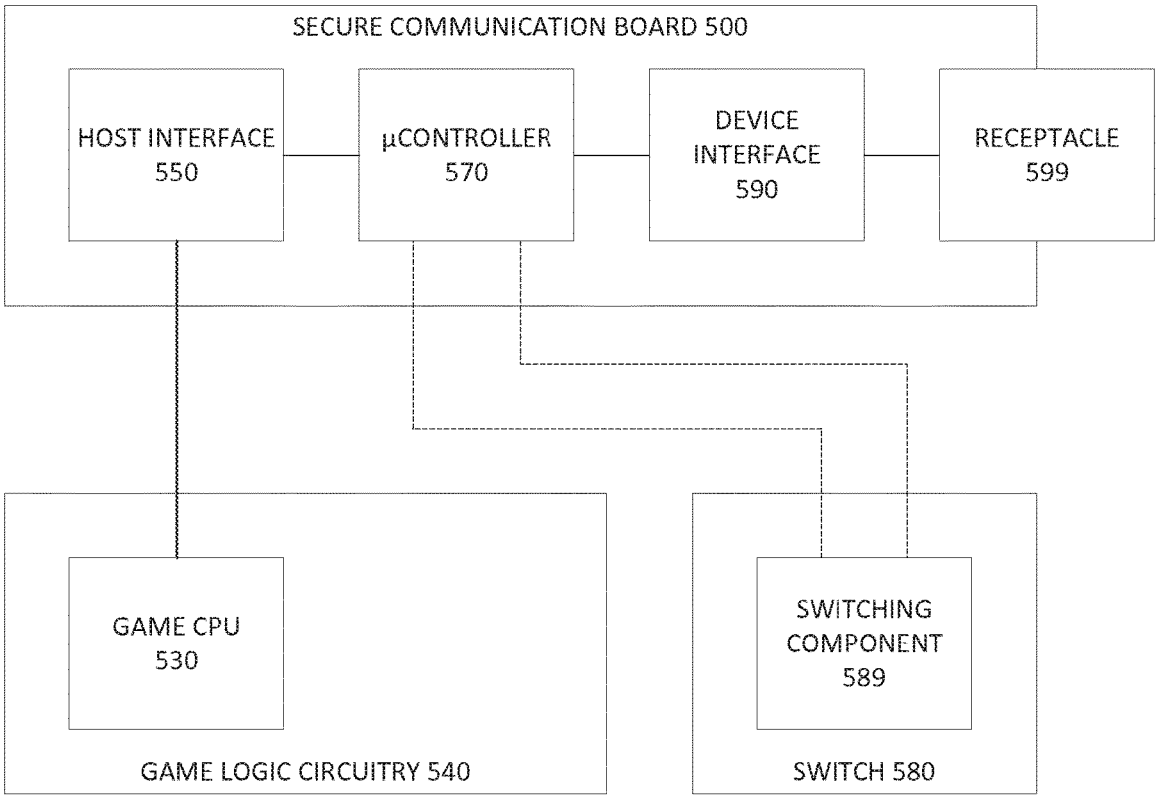
FIG. 5 is a schematic view of a secure communication board according to an embodiment of the present invention.

Referring now to FIG. 5, a schematic diagram of a secure communication board 500 is shown in one embodiment as implemented in a gaming system, such as the gaming machine 400. The secure communication board 500 includes a host interface 550, a dedicated microcontroller 570, a device interface 590, and a physical receptacle 599. While the receptacle 599 is shown as a component of the secure communication board 500, it is possible for the receptacle 599 to be directly or indirectly coupled to the secure communication board 500, and even physically separated or isolated from the secure communication board 500. Further, an additional receptacle 599 presented to the player or the external of the gaming machine in which it is mounted (not shown), may be connected to the receptacle 599 via an extension cable or other connective medium without departing from the spirit and scope of the invention. Lastly, the communication interface embodied by the receptacle 599 in this embodiment may alternatively be embodied as a different physical interface standard, or even a purely wireless communication module (e.g., a WiFi antenna, or Bluetooth, detailed later) in other embodiments. This includes wireless power charging devices and other types of interfaces between exterior mobile devices and the receptacle 599.

In one embodiment, the secure communication board 500 may be coupled directly to the game-logic circuitry 540 (and the gaming machine central processing unit (CPU) 530) of an EGM via an isolated internal bus of the EGM, a USB connective cable, or any other form of realizable connectivity, for example, IEEE 1394 (Firewire) or RJ45 (Ethernet) internal to the EGM. In another embodiment, the secure communication board 500 is coupled to the game-logic circuitry 540 via an intermediary backplane having associated connectors for each of these components (not shown). In some embodiments, the backplane collectively couples a wide variety of the components of the EGM, including display devices, input devices, audio devices, etc. The connectors used for coupling may be of differing types and need not conform to the same specification. The connectors may also include one or more individual connective elements (e.g., pins) for exchanging data and/or power between the components. The power and data may originate from various and different sources. For example, the connectors may exchange data exclusively between the secure communication board 500 and the game-logic circuitry 540, but only provide regulated direct current to the secure communication board 500 that is generated by a dedicated power source.

Once the connection between the secure communication board 500 and the game-logic circuitry 540 is established, control signals can be transferred between the various EGM modules and the secure communication board 500, providing various modes of operation to occur. Further, the coupling of the receptacle 599 to the secure communication board 500 (via the device interface 590) and connection of one or more switches 580 and microcontroller 570 may be of any arbitrary type.

In one embodiment, microcontroller 570 is a PIC controller as previously detailed, and may be integrated on a printed circuit board housing other components of the secure communication board 500, for example, the host interface 550 and device interface 590. The secure communication board 500 may have additional circuitry as well, to include enhanced functionality beyond the discussion at hand.

In some embodiments, the secure communication board 500 is also coupled to a switch 580 having a physical switching component 589. The switching component 589 enables the switch 580 to enter an "open" state when a mechanism of the switching component 589 is in a particular position. Alternatively, the switch 580 may require insertion of a key and/or rotation of a key into the switching component 589 in order to change the state of the switch 580 to "closed". The switching component may be optionally used to exclusively control the available modes of operation of the secure communication board 500 and receptacle 599 through the detection of the state of the switching component 589 and the use of control signals generated by the CPU 530, game-logic circuitry 540, and/or microcontroller 570. In many embodiments, the switch 580 provides state information of the switching component 589 to enable the microcontroller 570 to set or determine a corresponding mode of operation based on a number of factors that may include control signals from the game-logic circuitry 540, connected devices coupled to receptacle 599, user authentication, etc.

In one embodiment, the host interface 550 receives control signals from the game-logic circuitry 540 causing the microcontroller 570 to effect changes in operational modes of the secure communication board 500 and the communicative nature of the receptacle 599 during operation. The microcontroller 570 communicates with the receptacle 599 via the device interface 590, controlling the methods of power and information flow to and from the receptacle 599.

Control signals generated by the gaming machine game-logic circuitry 540 may be provided as a direct result of one or more events which occur in the wagering game. For example, the placement of a wager above some predetermined threshold may cause game-logic circuitry 540 to issue a control signal to the microcontroller 570 permitting power to flow to the receptacle 599 for a given period of time. Another example may include power flow to the receptacle 599 to occur during a bonus round of the wagering game, or alternatively, in response to a winning outcome of the wagering game. That is, the flow of power to the receptacle 599 may even be realized as an award of the wagering game. In another embodiment, maintaining a credit balance above a predetermined minimum may be specified as sufficient to maintain a constant flow of power to an externally accessible interface. Another example may include providing power to one or more interfaces while the player sustains a given wager rate over a number of game instances, or exceeding a predetermined number of game initiations in a given period of time. When using and measuring metrics that span multiple wagering-game instances, the number of games that occur and/or the amount of funds which are wagered may be measured or compared to any predetermined value to entice players to place more frequent, or greater, wagers.

Any combination of these wagering-game states and states of physical components of the EGM may be used to define a set of operational modes that the EGM and accessible interfaces operate in. For example, the control signals generated by one or more EGM components, including the game-logic circuitry 540, may be used to directly enable the microcontroller 570 of the secure communication board 500 to selectively provide power and/or data via the receptacle 599. Control signals generated by the microcontroller 570 are likewise capable of selectively providing power and/or data via the receptacle 599. Thus, there are two kinds of control signals: power control signals generated to impact or control power flow and data control signals generated to impact or control data flow in one or more directions. It is possible for a single control signal to act as either, or both, the power and data control signals.

In one embodiment, the secure communication board 500 operates to enable the receptacle 599 with constant power in the most basic of operating modes. In one embodiment, the operating mode enabling the provision for application of power to the receptacle 599 is a result of a power-enabling control signal being received from the game-logic circuitry 540 by the host interface 550. The game-logic circuitry 540 may be specifically programmed to issue control signals to the microcontroller 570 of the secure communication board 500 to control power flow to the receptacle 599 by engaging this specific mode of operation in response to a number of potential triggers, both related or unrelated to occurrences in the wagering games and states of components of the EGM.

Altering the voltage level delivered to the receptacle 599 operating in conformance with USB is also possible, but may not be desirable due to a lack of conformance to one or more of the defined USB standards. A fully conforming approach may include delivering power for a specified amount of time, or vary the amount of current through the charging circuitry interface when power is supplied. While a receptacle 599 conforming to standard USB provides a five-volt (5V) power supply, the actual current (measured in milliamps or mA) may conform to one of several kinds of logical USB ports defined by the current USB specification. A USB port may be considered a standard downstream port, a charging downstream port, and/or a dedicated charging port, depending upon the function of the port and one or more modes of operation of the secure communication board 500 and the receptacle 599. A standard downstream port is capable of delivering up to 500 mA (0.5 A) according to the USB 1.0 and 2.0 specifications, and delivering up to 900 mA (0.9 A) in USB 3.0. A charging downstream port and dedicated charging port provide up to 1500 mA (1.5 A). Other (non-standard) USB charging interfaces may provide other levels of current, including the Apple™ iPad charger (2.1 A), the Amazon Kindle Fire™ charger (1.8 A), and generic car chargers (ranging anywhere in the range 1 A to 2.1 A). As a general rule, the use of any of these charger specification specifics is routine for one having ordinary skill in the art; the use of associated circuitry for any voltage and current delivery specifications for an USB receptacle port is within the spirit and scope of the present invention, and will be omitted for the sake of brevity.

In one embodiment, the secure communication board 500 includes receptacle 599 operating in a power-only mode, providing voltage for a predetermined amount of time in response a player wagering an amount which exceeds some minimum value on the wagering machine. The voltage and amperage may be additionally controlled to be suitable for minimal or maximum charging, based on states and conditions of components as dictated by the microcontroller 570 and the game-logic circuitry 540. The supply of voltage may be provided in response to any wagering game state or event, such as a predetermined level of credits in the wagering game, or the triggering of an in-game event. Alternatively, the power-only mode of operation may provide power delivery to one or more additional or alternative powering receptacles (not shown), for example, wireless power or from a separate and distinct connector or jack. Some details regarding this type of embodiment will be covered in following sections, but the overall impact of the control signal(s) to cause operation in a power-only mode serves an identical purpose as the current embodiment.

In another embodiment, the receptacle 599, dependent upon component states and conditions, operates in a power-communication mode that may include a one-way communication auditing mode providing power and information from the gaming machine to the connected device via the receptacle 599, a one-way communication authentication mode providing power to and allowing flow of information from the connected device to the gaming machine via the receptacle 599, or a two-way communication mode providing power and bidirectional communication between connected device and gaming machine via the receptacle 599. The initiation of a data communication mode will generally involve one or more processes of user authentication to ensure that the communication with the EGM is properly authorized.

Initiation of any specific operating mode, and/or power flow levels to the receptacle 599 may occur as a result of a command or control signal issued by the gaming machine or game-logic circuitry 540, the microcontroller 570, or the current position of one or more physical switches, among other security mechanisms. In one embodiment, a security mechanism is used to detect whether access to the internal "cash box" door latch of the EGM is open or closed, causing a resulting control of the operational mode of secure communication board 500 and receptacle 599. A security mechanism may also (or alternatively) be placed on the main access door/panel of the EGM to engage specific mode(s) or limitations when the gaming machine cabinet or one or more switches are not in a completely secured (i.e., closed) state.

That is, in one embodiment, the states of one or more internal security switches are used to control operational modes and communication flow through the receptacle 599 by configuring the microcontroller 570 to control the operations the secure communication board 500 may perform. Another embodiment includes the turning of an administration key switch which allows an administrator or authorized technician to enter diagnostic modes, clear faults, etc., and/or present or verify authentication via the receptacle 599 (or graphical user interface) to engage the one-way and two-way communication information flow modes between a connected USB device and the EGM via the receptacle 599 and microcontroller 570. The failure to engage one or more modes of operation will typically prohibit or limit the flow of power and/or communication through the receptacle 599.

In one embodiment, the secure communication board 500 acts as a USB hub having a single device port that must be specifically enabled by the gaming machine CPU 530 via the microcontroller 570. For example, the microcontroller 570 disables any data flow to the receptacle 599 until specifically enabled by a command or control signal received by the game-logic circuitry 540. This command may be received via the host interface 550 or be directly tied to a security device such as a key switch or an actuated switch on the interior of the gaming machine. In another embodiment, the command controls the secure communication board 500 to perform in operational modes including the flow of power through the USB interface, enabling the gaming machine to enable and disable the receptacle 599 based on game specific states, including a current or pending wager, wager size, game winning state, as a prize, etc.

In one embodiment, the device connecting to the receptacle 599 includes a USB thumb drive which provides a digital fingerprint used for authentication and effects engagement of one of multiple modes of operation of the secure communication board 500, the receptacle 599, and the gaming machine as a whole. Alternatively, a USB key access fob or other digital storage device may be used to store and present digital fingerprints for authentication procedures.

The secure communication board 500 may additionally provide combinations of various operational modes in response to combinations of states and control signals. As other components are added to or coupled with the secure communication board 500, the various control signals can be manipulated by the microprocessor 570 to provide an operational mode for power and information flow via the secure communication board 500 for every possible combination.

In addition to different modes of operation, differing levels of communicative access may be granted based on the type and level of authentication. For example, when communication via the receptacle 599 is enabled by the secure communication board 500, the states of one or more switches, in addition to the operating mode of the secure communication board 500 and the state of the wagering machine (cabinet and/or game), may dictate the ability of an administrator to perform a specific function. These specific functions may include transferring audit-information, adjusting gaming-configuration parameters, and updating the cabinet firmware or software of the gaming machine.

In one embodiment, the microcontroller 570 may also be configured to provide a NULL mode of operation for the secure communication board 500, such that during the NULL mode, power and/or communication flow are not delivered to the receptacle 599. Essentially, a secure communication board 500 operating in a NULL mode cannot use the receptacle 599 in any capacity, for any purpose. In this embodiment, the microcontroller 570 is programmed to detect a physical key switch that must be "closed" (e.g., key inserted and key turned) in order to activate the receptacle 599 for any power or communication delivery—the operational modes potentially based upon other, additional conditional states. For example, once the physical key switch is closed, the receptacle 599 may be used to connect a USB compatible HID, connect a USB compatible device providing digital fingerprints for user authentication, provide a basis for advanced authentication of one or more users at one or more levels of access, provide non-volatile memory used to store record information retrieved from the gaming machine, provide software or firmware upgrades to the gaming machine, etc. This embodiment provides advanced security, minimally requiring that communication with the gaming machine cannot take place without the presence of a physical security key, in addition to optional user authentication(s).

The addition of an intelligently programmed microcontroller 570 also enables a variety of functional behaviors that include communications between the secure communication board 500 and the game-logic circuitry 540. Messages regarding the state of a conducted wagering game, the secure communication board 500, the host interface 550, the microcontroller 570, the switch 580, and the device interface 590, may be generated to control one or more operational modes of the secure communication board 500.

For example, a message may be generated in response to a device being coupled to the receptacle 599, or as a result of a switch 589 changing state. The operational modes of the secure communication board 500 may cause the receptacle 599 to become active and accessible based on a signal or message generated by the game-logic circuitry 540 only when the wagering game is being played. In one embodiment, credits from one or more credit meters may be required to force the player to pay in order to charge a connected device by using credits.

Messages originating from the secure communication board 500 may result in messages being displayed on the EGM display device(s) (by the game-logic circuitry 540) as a result of states of the secure communication board 500, for example, whether a device has been coupled to the receptacle. Information received from the secure communication board 500 may also be combined with wagering game state information to alert the player to various conditions. For example, upon "cashing out", a player may be reminded not to forget a connected device when a device is still connected to the receptacle 599. Further, the player may be informed when a connected mobile device is fully charged, or if electrical current delivered to the receptacle 599 is being limited.

Other communications between the secure communication board 500 and the game-logic circuitry 540 may also occur based on the type of device connected or the configuration of the connected device. For example, a device connected to the receptacle 599 may be recognized as containing a digital signature (or some other type of authentication) that may trigger a specific mode of operation or a requirement for further authentication. Further, information (including identification numbers, images, databases, etc.) stored in a mobile device coupled via the receptacle 599 may become accessible and used by the game-logic circuitry 540 and/or the microcontroller 570 to cause visual, audio, or other indications perceivable to the player and/or others.

In one embodiment, a mobile device (e.g., mobile phone, tablet, electronic key fob, security token, radio-frequency identification (RFID) device or card, etc.) may include information, files, or software identifying a particular player of the wagering game. The connected nature common in modern casinos may include player tracking systems that track the wagering patterns of players and provide benefits for wagering at particular devices and locations. The secure communication board 500 may limit use of the receptacle 599 to charge mobile devices that are specifically configured with particular applications (e.g., "apps") compatible with the wagering game. In one embodiment, only devices belonging to players currently registered or enrolled in a loyalty program may use the receptacle 599 for charging mobile devices.

FIGS. 6A-6D are schematic diagrams for four differing embodiments of secure communication boards 601-604. Alternatively, this may be considered to construe four differing modes of operation that the secure communication board 500 may be configured to operate when the external interface of the secure communication board is specifically compatible with USB. That is, the specifics of the various forms of the secure communication board 500 may be construed as shown by secure communication boards 601, 602, 603, and 604, reflecting a number of different configurations of active components as detailed in regard to the secure communication board 500.

The various component configurations shown in FIGS. 6A-6D provide distinct secure communication boards 601-604 having a wide variety of functional operation to users of the external interface 699. While it is well within the scope and spirit of the invention to construct distinct secure communication boards 601-604, the unified secure communication board 500 may be considered as encompassing each of the distinct, differing modes of operation that are described herein for secure communication boards 601-604. That is, any or all of the functional modes of operation described by the secure communication boards 601-604 may be realized by the secure communication board 500 having each of the described functional elements. For example, the microcontroller 570 may be programmed (e.g., software, firmware, or any combination) to enable the secure communication board 500 and receptacle 599/699 to operate in one or more operational modes as described for FIG. 6A-6D using corresponding components coupled therewith. Alternatively, operation of any of the secure communication boards 601-604 may be controlled by one or more components of the game-logic circuitry, for example, a game CPU 42 of the EGM.

As previously noted, the replacement of the receptacle 599 of the secure communication board 500 with a generalized set of power and communication external interface receptacle 699 is also possible. When reviewing secure communication boards 601-604, the external interface receptacle 699 may be suitably replaced or alternatively coupled with any combination of power and communication interfaces, including wireless power and communication modules using induction modules, or another type of physical power and data communication connection standard.

Figure 6A:
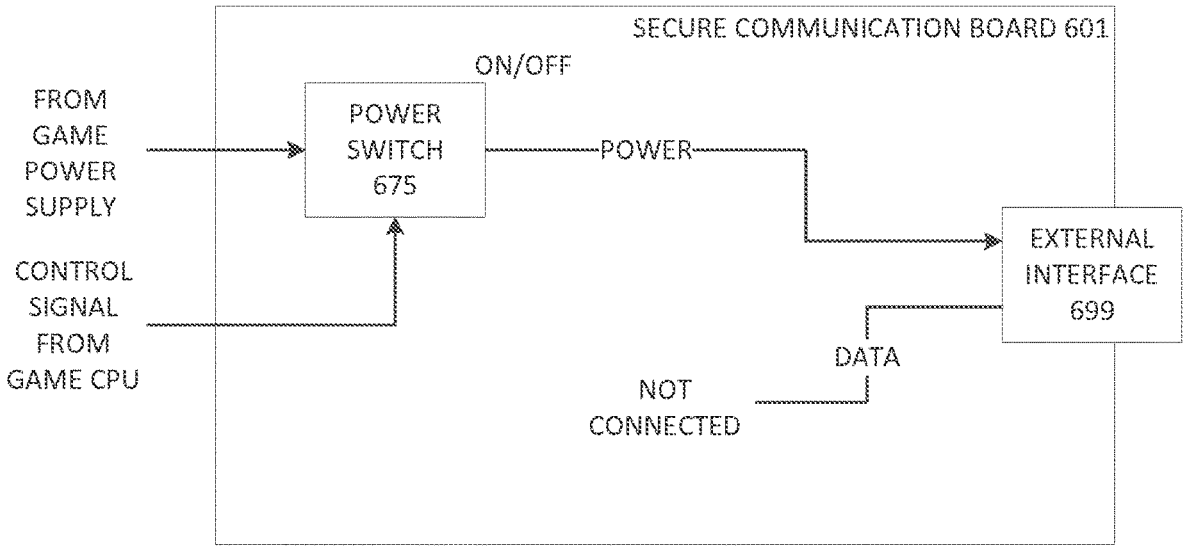
FIG. 6A-6F are schematic views of a gaming system secure communication board specifically configured with specialized components that may be operationally restricted for operating external gaming machine interfaces in distinct modes according to an embodiment of the present invention.

FIG. 6A is a schematic diagram of an embodiment including a secure communication board 601 comprising a power switch 675 and an external interface receptacle 699. The secure communication board 601 does not provide any data communication via the receptacle 699 at all. The receptacle 699 is equipped to provide only power to a connected (or proximal) device via the receptacle 699. The power switch 675 receives power from a gaming machine power supply (not shown) and responds to control signals sent from the gaming machine (e.g., game-logic circuitry 40). Alternatively, the power switch 675 could include a transistor serving to control and deliver power to the receptacle 699 when so dictated by the received control signal. In one embodiment, the functional behavior of the power switch 675 in FIG. 6A is strictly programmatically performed by a microcontroller (not shown), which may be similar to microcontroller 570. The power switch 675 may also be a dedicated and physically separate element mounted on secure communication board 601 to perform this function, or be a functionally integrated element performed by an on or off board microcontroller (e.g., microcontroller 570, or alternatively, the game-logic circuitry 40/540).

During operation of the secure communication board 601, the receptacle 699 cannot provide a data connection under any circumstances, as the data pins in the socket of the receptacle 699 are not connected to anything. However, the power pins of the receptacle 699 are configured to supply power to an external device upon connection, such as a phone, mobile computer, or battery device. This is a very secure mode that prohibits any communication with internal gaming machine components while still providing some useful features to players. Alternatively, receptacle 699 may be replaced or supplemented with a wireless power module (not shown) which provides power in accordance with the current operational mode.

In this embodiment, the communication board 601 would typically be used solely for charging or supplying power to connected devices, and the power switch 675 is controllable by the gaming machine (e.g., the game-logic circuitry 540). This allows operating modes that include enabling power only when there are a predetermined amount of credits on the EGM, enabling power for a set period of time every time a predetermined minimum wager is placed and a wagering-game instance is played, or providing power as long as a predetermined rate of play or wager amount is being performed on the EGM during a given period of time. Many of these modes of operation are useful to prevent players from simply sitting at an EGM charging their electronic devices while not actively gambling or interacting with the EGM and preventing other players from using the EGM. Another operational mode may require a specified sustained interaction with the EGM to maintain power flow, for example, providing thirty seconds of power for each wager placed, although any period of time may be specified.

Figure 6B:
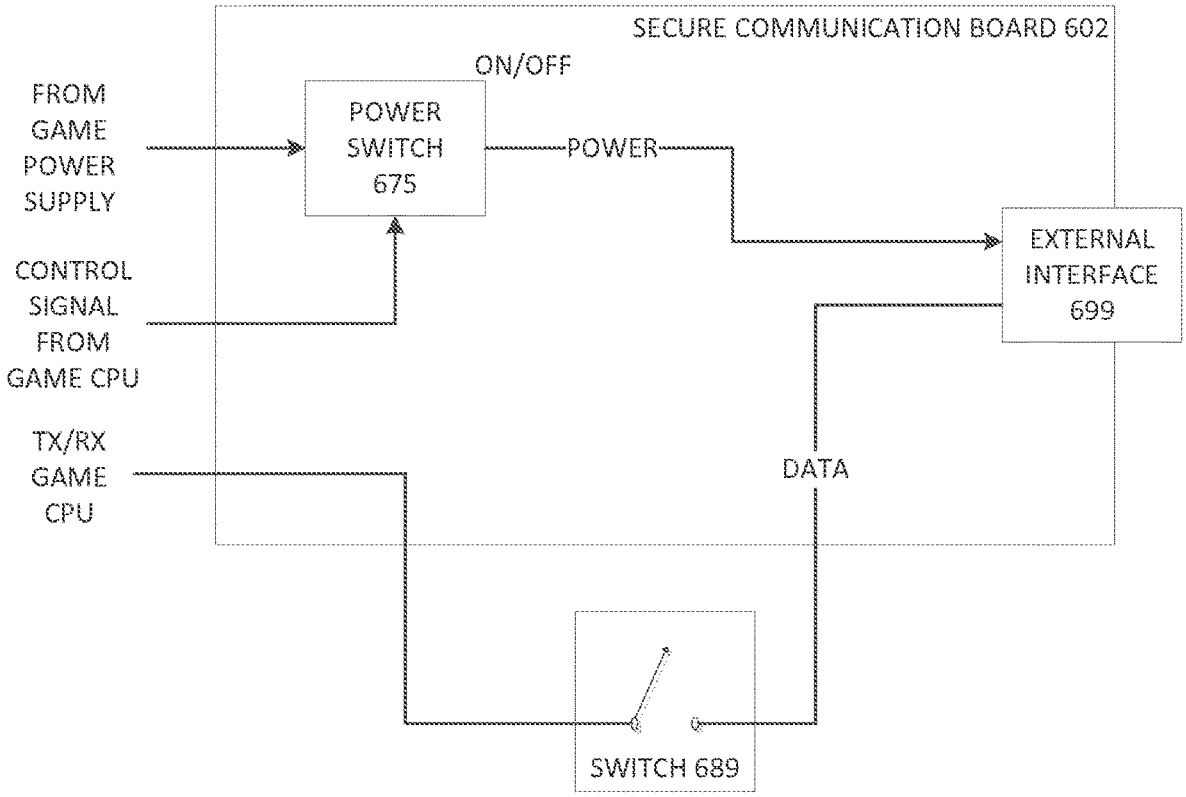

FIG. 6B is a schematic diagram of another embodiment including a secure communication board 602 comprising a power switch 675, and an external interface receptacle 699. The secure communication board 602 is coupled to a physical security switch 689, enabling data communications to flow through the switch 689 in certain circumstances. The physical security switch 689 may be externally mounted on the EGM or shielded within a compartment of the EGM, visible or hidden. The physical security switch 689 may be, for example, a key switch, which has two states: an "open" state such that no data can flow through the open switch and a "closed" state such that data signals are capable of flowing through the closed security switch 689.

The secure communication board 602 adds the capability of providing controlled and selective data connection at the receptacle 699. In this embodiment, at least one of the communication data lines are routed through the secure communication board 602 to contacts coupling with the switch 689 (typically mounted on or in the gaming machine), and through the secure communication board 602 to the receptacle 699. As before, one or more processors, (e.g., CPU 530, other controllers of a PIC, etc.) may also be configured to selectively activate or deactivate the power switch 675, either directly or via a proxy microcontroller (not shown) using a suitable control signal. Alternatively, an additional USB microcontroller (not shown) may be used to provide additional, or interpret received, control signals specific to USB operations.

Typically, when a key switch (e.g., key switch 489) is being implemented as the switch 689, the contacts of the key switch would be open by default thereby preventing data from being accessible at the receptacle 699 unless the key is in the key switch and the key switch is turned. This approach requires additional switch contacts because a processor (e.g., CPU 530) also must monitor the key switch for current state (i.e., open or closed) to provide data security and protection from unintentional access via the receptacle 699. The secure communication board 602 may also allow a technician to connect a pointing device (e.g., a mouse), tablet, or other device to the gaming machine using the receptacle 699 while interacting with the gaming machine (and the key switch activated to enable communications).

Figure 6C:
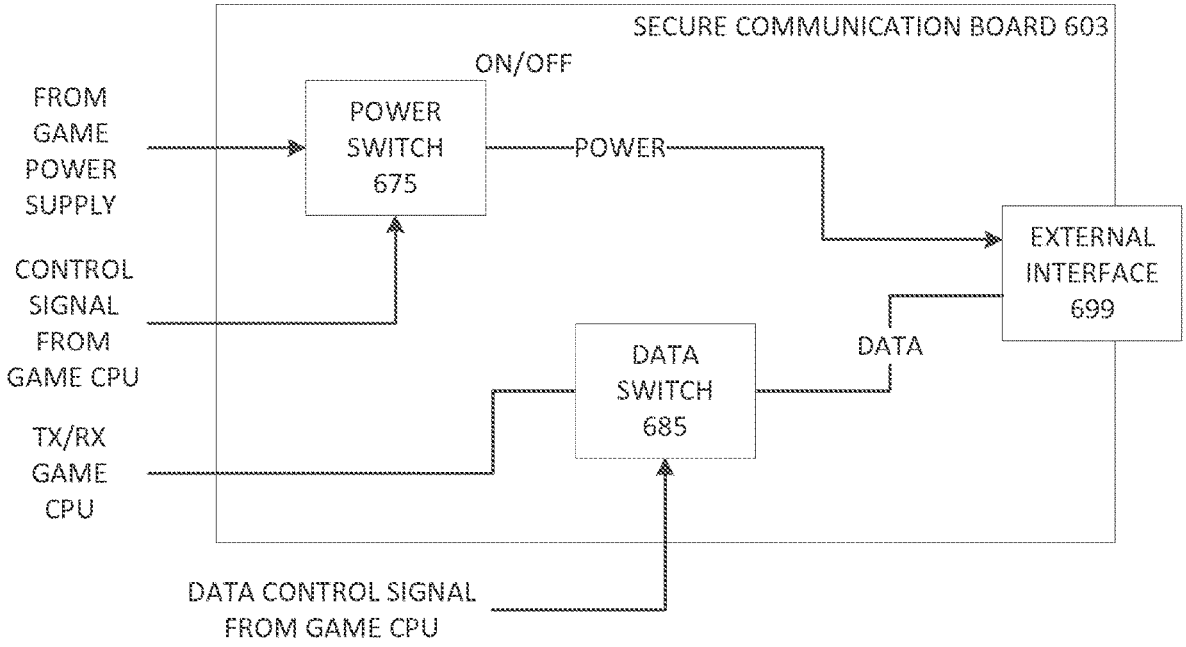

FIG. 6C is a schematic diagram of another embodiment including a secure communication board 603 comprising a power switch 675, a data switch 685, and an external interface receptacle 699. A processor (e.g., CPU 530, remote PIC, etc.) is configured to send control signals to the secure communication board 603, including the power switch 675 and the data switch 685. Functionally, secure communication board 603 is similar to the secure communication board 602 described prior. However, instead of routing the data communication signals through a key switch, the data signals are routed through an electronic data switch 685 on the secure communication board 603. For example, this electronic data switch 685 may be an off-the-shelf analog switch compatible with USB 2.0, such as the MAX4906/MAX4906F/MAX4907F manufactured by Maxim Integrated, 160 Rio Robles, San Jose, Calif., 95134 USA, or the like. A data control signal sent from the game-logic circuitry 540 could be used to activate the data switch 685 and allow the data communications from the game-logic circuitry 540 to be presented at the receptacle 699 (and vice-versa). In one embodiment, the absence of a data control signal received by the CPU 530 defaults the data switch 685 to the "open" state, disabling data communications through the data switch 685.

The secure communication board 603 allows slightly greater flexibility in enabling data communication than the secure communication board 602. For instance, secure communication board 603 may be configured to grant data communication and communication access to the player/user via the receptacle 699 only under controlled circumstances specifically dictated by the gaming machine itself. In one embodiment, the secure communication board 603 may also provide data access granted to a technician without an active key switch by sending an enabling command message (e.g., a control signal) from a back end system component relaying the control signal command to the game-logic circuitry 540 that activates a data control signal to permit data transfer. The data control signal could also be generated by a switch contact on a key switch instead of from the game-logic circuitry 540. One advantage using the secure communication board 603 includes high-speed data communication signals not being routed through a set of switch contacts that could compromise signal fidelity.

Figure 6D:
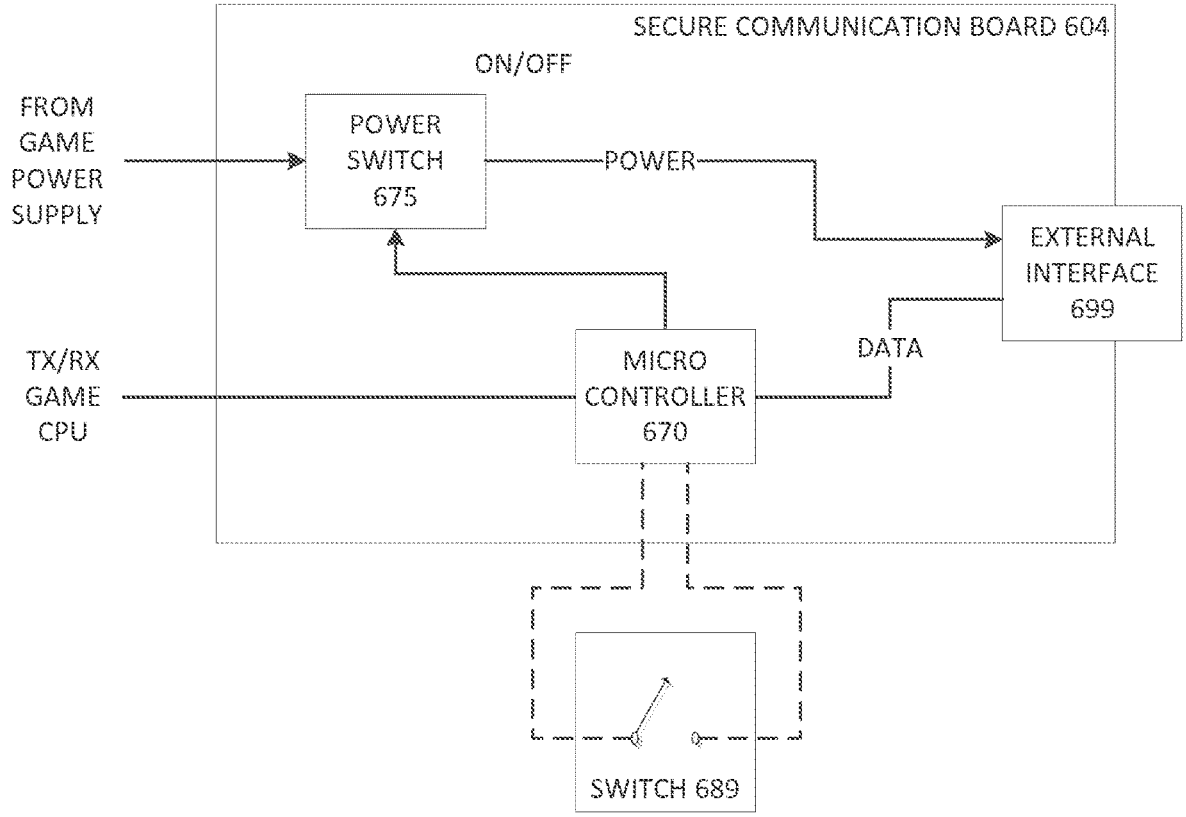

FIG. 6D is a schematic diagram of another embodiment including a secure communication board 604 comprising a power switch 675, a microcontroller 670, and an external interface receptacle 699. The secure communication board 604 is coupled to a switch 689, which may be a physical security switch, a key switch, etc., via the microcontroller 670.

The microcontroller 670 can be realized by use of a PIC enabling two-way communication between the communication board 604 and one or more game controller(s) of the game-logic circuitry 540 as detailed prior. The use of a programmed microcontroller 670 interfacing with other components on the secure communication board 604 (e.g., the power switch 675, the switch 689, etc.) enables control of the selective flow of both power and data. Further, the rate and type of data that flows through the secure communication board 604 may also be intelligently and programmatically controlled by one or more of the game-logic circuitry 540 and the microcontroller 670.

The microcontroller 670 that directly controls the flow of data in addition to the operation of the power switch 675 may be mounted (i.e., integrated) on the secure communication board 604, or be remotely located. The microcontroller 670 responds programmatically upon states of components of the secure communication board 604, including the switch 689. The microcontroller 670 may also respond directly to commands issued from another processor (e.g., game-logic circuitry 540).

In one embodiment, the microcontroller 670 may have a USB port coupling to the gaming machine game-logic circuitry 540 (not shown), and another USB port facing the receptacle 699. The signal to enable data communication to flow through the microcontroller 670 may be a direct result of the state of the switch 689, from one or more control signals from the processor (e.g., using a USB command), or a combination of both. In some embodiments, the secure communication board 604 presents itself as two USB devices when viewed by the game-logic circuitry 540; the game-logic circuitry 540 detects the receptacle 699 as one device and the microcontroller 670 as another device. Commands which enable power flow to the receptacle 699 via the power switch 675 and/or the flow of data communications through the microcontroller 670 may be sent from another processor (e.g., CPU 530) to the microcontroller 670. This configuration has the advantage of simple interconnection to the EGM and remotely located processors.

Figure 6E:
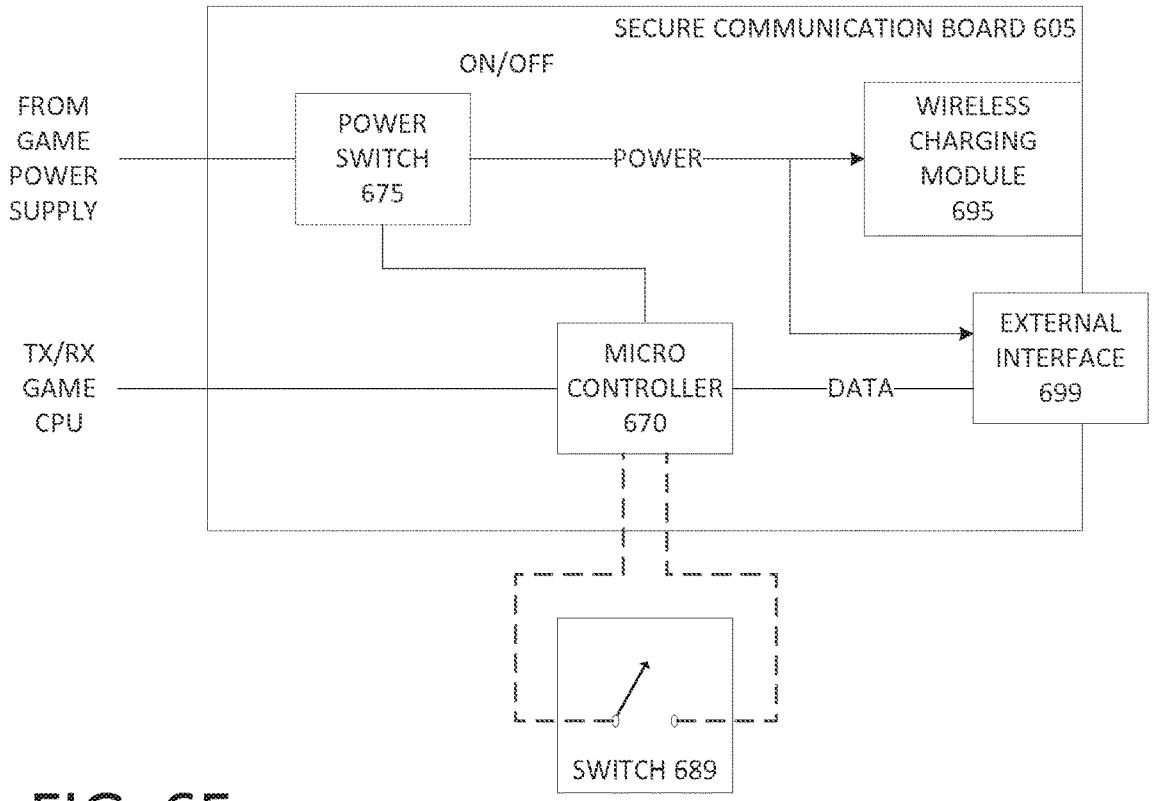
Figure 6F:
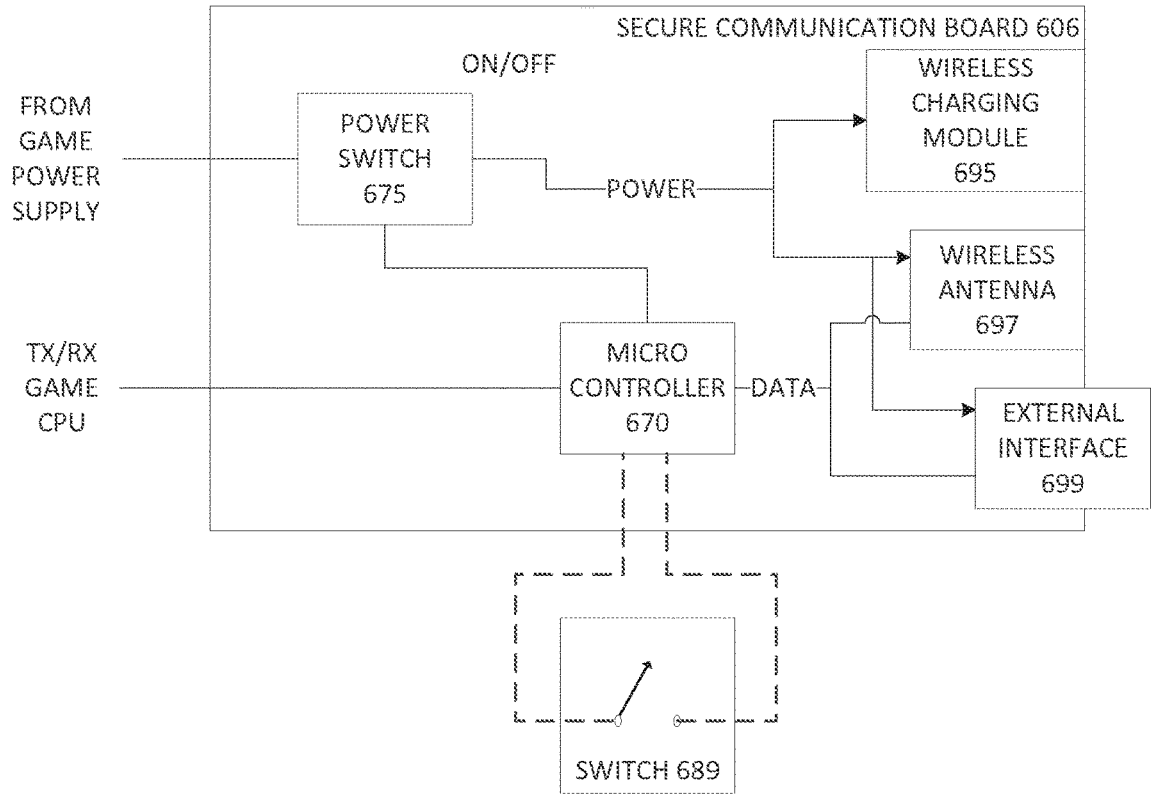

FIGS. 6E-6F schematically diagrams two additional embodiments of the invention having a provision for wireless power delivery and/or wireless communications, parallel to or independently from the receptacle 699.

FIG. 6E is a schematic diagram of another embodiment including a secure communication board 605 comprising a power switch 675, a microcontroller 670, a wireless charging module 695, and an external interface receptacle 699. The secure communication board 605 is coupled to a switch 689, which may be a physical security switch, a key switch, etc., via the microcontroller 670.

The microcontroller 670, which directly controls data communication flowing through it, also controls the power switch 675 to control supplying power to one or more components of the secure communication board 605. The microcontroller 670 may be mounted on the secure communication board 605 or be remotely located. The wireless charging module 695 provides components for the system to use electromagnetic fields (via induction) to provide power for charging to proximal devices including phones, mobile devices, etc. The wireless charging module 695 may use any suitable standard for supplying wireless electrical power to proximate devices. There are multiple emerging standards in this area, including the Rezence interface standard developed by the Alliance for Wireless Power (A4WP) of Beaverton, Oreg., the Qi interface standard developed by the Wireless Power Consortium of Piscataway, N.J. standards and protocols by the Power Matters Alliance (PMA) of Houston, Tex., among other standards. The secure communication board 605 preferably remains compliant with one or more industry standards for power and communications and serves to supplement power provision to the receptacle 699.

The microcontroller 670 may respond programmatically upon states of the secure communication board 605 and other system or board components including the switch 689, as detailed prior. The microcontroller 670 may also respond directly to control signal commands issued from another processor (e.g., game-logic circuitry 540). In one embodiment, the microcontroller 670 has a USB port connective coupling to the game-logic circuitry 540 (not shown), and another USB port coupling to a USB receptacle 699. A control signal to enable data communications to flow through the microcontroller 670 may be a direct result of the state of the switch 689, from one or more control signals transmitted from the game-logic circuitry 540 (for example, using a USB command), or a combination of both. Commands and control signals which enable or activate the flow of power via the power switch 675 and/or the flow of data through the microcontroller 670 may originate from another processor (e.g., CPU 530) and are received and processed by the microcontroller 670. In another embodiment, power supplied and delivered to the receptacle 699 may be independent from the power supplied and delivered to the wireless charging module 695, as opposed to being conjoined and dependent upon the same power switch 675 output as shown in FIG. 6E. Any of the previously described modes of the secure communication board 605 may be adapted to provide wireless power instead of (or in addition to) the power connections of the receptacle 699 via wireless charging module 695.

FIG. 6F is a schematic diagram of another embodiment including a secure communication board 606 comprising a power switch 675, a microcontroller 670, a wireless charging module 695, a wireless antenna 697, and an external interface receptacle 699. The secure communication board 606 is (optionally) coupled to a switch 689, which may be a physical security switch, a key switch, etc., via the microcontroller 670, as detailed prior.

The microcontroller 670 directly controls the flow of data communications through it, along with the flow of power via the power switch 675. The microcontroller 670 may be mounted on the secure communication board 606, or be remotely embodied and suitably coupled. The flow of data communications through the microcontroller 670 may occur via the wireless antenna 697 and/or the receptacle 699, depending upon the current mode of operation, operational power to one or more of the components of the secure communication board 606, or specific programmatic design. Connectivity to the wireless antenna 697 and the receptacle 699 may be performed via the same conduit (i.e., bus), or by distinctly different physical and/or logical connections. In many embodiments, the secure communication board 606 remains compliant with one or more industry standards for power and provides selective power provision to the wireless charging module 695 and receptacle 699 (if powered). The wireless antenna 697 may be directly coupled to the secure communication board 606, collocated with the microcontroller 670 in the same gaming machine cabinet, or entirely separate from the gaming machine cabinet. In another embodiment, an external communication device could be used to establish data communications utilizing wireless and/or wired communication. Viable forms of wireless connectivity in this embodiment include Bluetooth and Wi-Fi communications standards, among others, the specifics of which are not critical to the understanding of the invention.

The microcontroller 670 responds programmatically to states of components of the secure communication board 606 and other system components, including the switch 689. The microcontroller 670 may also respond directly to control signal commands issued from a remote processor (e.g., game-logic circuitry 540). A control signal to enable data communications to flow through the microcontroller 670 between the EGM (e.g., game-logic circuitry 540) and the wireless antenna 697 or the receptacle 699 may be a direct result of the state of the switch 689, from one or more control signals from a remote processor (e.g., game-logic circuitry 540 via a USB command), a selective determination by the microcontroller 670, or any combination of these. Commands which enable power flow via the power switch 675 and/or the flow of data communications through the microcontroller 670 may be sent from a remote processor to the microcontroller 670, or may be solely made by the microcontroller 670. As above, power supplied and data communications delivered to the wireless charging module 695, wireless antenna 697, and/or receptacle 699 may be independent from the power supplied and data communications delivered to the wireless charging module 695 of the wireless antenna 697. Further, any of the previously described modes of the secure communication board 606 may be adapted to provide wireless power and data communications flow, instead of (or in addition to) the power flow and data communication connections of the receptacle 699.

Figure 7:
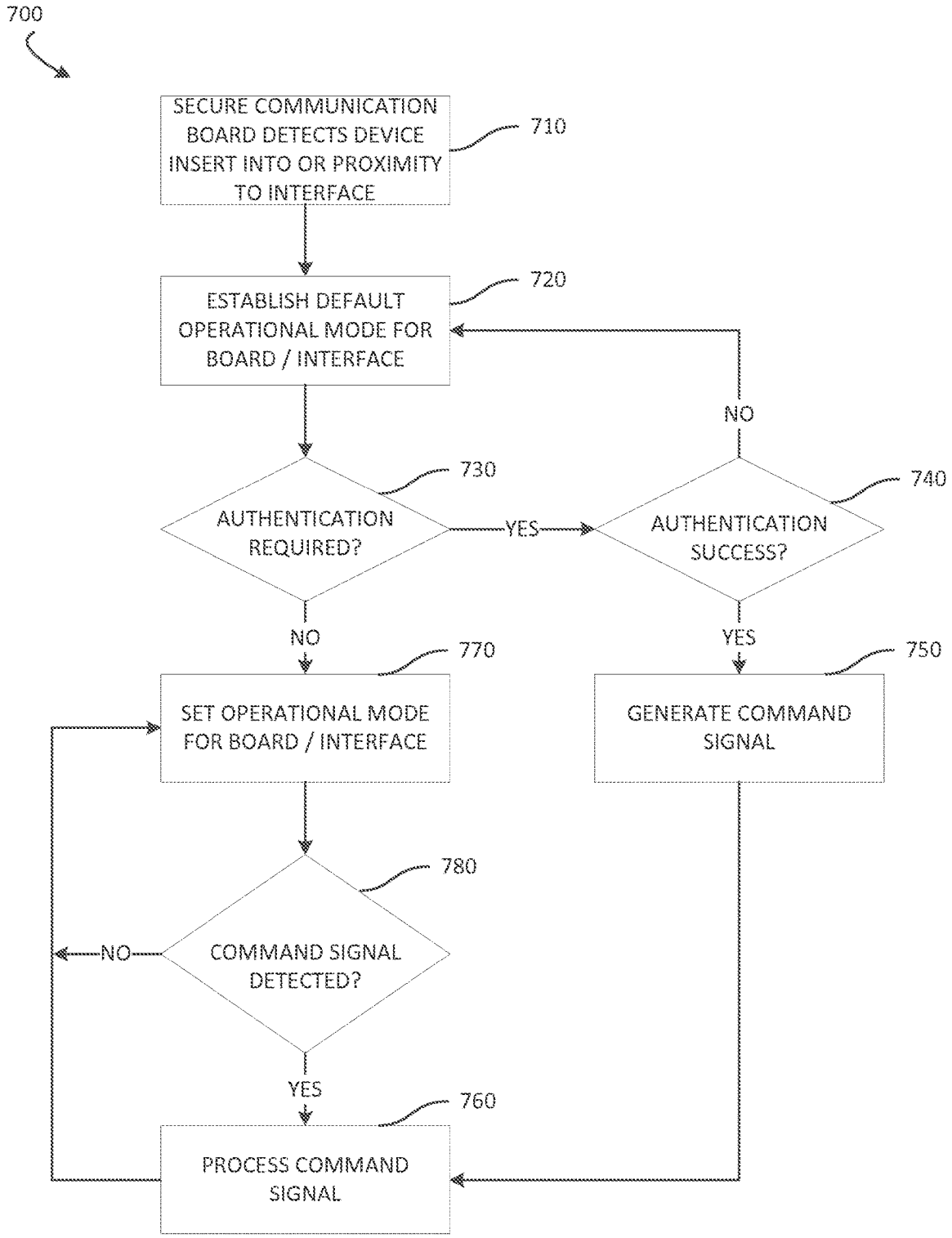
FIG. 7 is a flowchart for an algorithm for a process corresponding to the operation of a gaming machine having a secure communication board according to an embodiment of the present invention.

Referring now to FIG. 7, a generalized process 700 for controlling and operating the modes of operation for a receptacle 599 using a secure communication board 500 is detailed for one embodiment. The process 700 may be used, in portion or entirety, in combination with use with any of the embodiments (or modes of operation) detailed above in FIGS. 6A-6F, and with any suitable interface type that may or may not be USB conformant. For example, the specifics of the components used to manufacture or implement the communication board 200 will ultimately dictate the precise function of the process used with the resulting device in combination with the element components of the given communication board 200. The process 700 serves as an overview of one example of how one specific type of communication board 200 (i.e., the secure communication board 500) operates to regulate and selectively control power and data flow between components of the system. Various forms of process 700 may be used in conjunction with secure communication boards 601-606 and other types of communication board 200.

In step 710, the secure communication board 500 detects a mobile device connecting to the receptacle 599. The mobile device may comprise a pointing device, non-volatile memory storage device, a passive (or active) mobile device, tablet, phone, etc. In regard to use of a USB receptacle 599, the detection of USB device insertion and removal is known in the art and will not be discussed in full for the sake of brevity. Alternatively, a determination may be made regarding a mobile device proximity to a wireless charger and/or communication interface.

In a case when no detection of a connected or proximal device occurs, no suitable connectivity information can be obtained or determined. This detection and set of defined component states may dictate or guide future operational modes of the secure communication board 500. For example, power flow to the receptacle 599 may occur only while a connected device is detected, determined separately from an operational mode having wireless power delivery and/or wireless antenna capabilities.

In step 720, a default operational mode is selected for the secure communication board 500 and the corresponding components, including the receptacle(s) 599, and/or wireless charging module 695 and wireless antenna 697. For ease of explanation, the receptacle 599 will be used to describe the process of setting modes for the secure communication board 500, but it is understood that any number and type of power and/or data communicative interfaces may be enabled for usage using the secure communication board 500 and process 700.

The specific default mode for the secure communication board 500 may be further based or determined upon the state of various wagering game machine factors, including security mechanisms (physical and/or electronic), wagering game states (including wagering game events), specified administrative preferences, timing constraints, etc. Additionally, the operational default mode may be a result of previously attempted authentication (either failed or succeeded), a persistent or determined state of one or more components of the wagering game machine, or assigned as specified by a configuration setting. The chosen default mode may further include any defined operational mode of the secure communication board 500, including no power and no communication mode (e.g., an OFF mode), a power-only mode, a one-way communication read only power-data mode (for data flow in either direction), or a limited two-way communication power-data transfer mode (for example, accessing casino specific local-area-network traffic or services only).

In step 730, a determination is made as to whether authentication is required for activation or usage of the receptacle 599 (or other communication interface). Authentication may include the swiping of a customer card, the insertion of a mobile memory device containing authentication information, and/or the input of a security code or passphrase. Examples of authentication information may include digital signature(s) provided via a mobile device, a radio frequency identification (RFID) badge, a combination of presented keys, badges, or authentication measures either automatically read by one or more system components or input by a user or technician at the time of authentication. Alternatively, authentication may be the detection of a corresponding control signal, received either by the gaming machine or the microcontroller 570, also based on one or more of these factors. In some cases, the presence of a control signal enables the secure communication board 500 to operate in a specific mode (e.g., two-way communication), while the absence of such a signal causes the secure communication board 500 to operate in a different specific mode (e.g., power only).

In step 740, when it is determined that authentication is required, an authentication process is performed. Once completed, a determination is made as to whether the authentication succeeds. This determination may include requirement of authentication success in a predetermined amount of time. In the event that the authentication fails (i.e., the input is rejected, missing, or time elapses), process flow returns to step 720, where a new or contingently default operational mode may be chosen. The selection of a new (or additional) default operation mode may allow the secure communication board 500 and the receptacle 599 to be used in a specified operational mode without the requirement for further (or any) authentication.

In one embodiment, a default mode is chosen for the secure communication board 500 and an additional query is made to the EGM (e.g., game-logic circuitry 540) to provide or specify a particular operational mode commensurate with the security level for a successfully completed authentication of the type provided. For example, a different operational mode may be specified upon successful authentication of an EGM auditor technician as opposed to a casino supervisor or technical specialist. Alternatively, the secure communication board 500 may be programmed to provide a determination of an operational mode based on the state of one or more components of the gaming system and/or in accordance with input from the EGM via the game-logic circuitry 540.

A command message (most often an actively generated control signal in response to a component state and/or at processor discretion) may be transmitted to one or more processes or components present on the secure communication board 500 to verify or specify successfully performed authentication and an appropriate default operation mode for the receptacle 599. In one embodiment, in response to the generated command message, combined with proper user authentication, the game-logic circuitry 540 issues a command message indicating that the secure communication board 500 and the receptacle 599 will operate in a specifically designated power-data mode, for example, two-way communication, when communicating with a specific process of the EGM.

In step 750, once a determination is made regarding the mode of operation of the secure communication board 500 and the receptacle 599 (potentially including configuration and parameter settings for the secure communication board 500 and the receptacle 599 during the designated operational mode), a command message is generated and is transmitted to the appropriate component(s) of the secure communication board 500 for processing. This command message (e.g., a control signal) may be generated by one or more components of the game-logic circuitry 540, one or more microcontrollers 570 on the secure communication board 500, or both, and provides state information for one or more of these processors to process the state of the system to determine the proper operation mode of the secure communication board 500.

In step 760, the command message is suitably processed by the one or more processors. This may include comparative processing or analysis of received or stored data or signals. Again, the command message may include a directive from a processor of the secure communication board 500, itself, or from the EGM (e.g., gaming central processing unit 530) used to control the operating mode of the secure communication board 500 and the receptacle 599 when operating in a power-data mode. As detailed prior, various messages from the microcontroller 570 and/or the game-logic circuitry 540 may result from mobile device insertion or removal, security (physical and electronic) switch state changes, game state changes, game events, successful authentication, authentication time period elapses, etc. When these command messages are received and processed by the secure communication board 500, the operational state of the secure communication board 500 and the receptacle 599 are specified to change or alternatively, continue unaltered in the current or a default mode of operation. An operational mode change may occur after, or substantially simultaneously, with the setting of other system variables impacted as a result of the received command message.

In step 770, following the processing of a command message, or alternatively, in response to no authentication being required, the appropriate operational mode based on component states and configuration settings is selected for the secure communication board 500 and the receptacle 599. This state now defines the routine operation of the secure communication board 500 in its current operational mode. The secure communication board 500 and the receptacle 599 will operate in the specified operational mode until a state change occurs which dictates a change in the operational mode of the secure communication board 500 and the receptacle 599 (e.g., a physical security switch state change), or an additional command message is received (e.g., generated by the microcontroller 570 or game-logic circuitry 540).

Thus, when appropriate, the command message (e.g., control signal) is processed to determine any effect on the operational status of the secure communication board 500 and the receptacle 599, including the current operational mode and specified configuration variables of the secure communication board 500 and components. In one embodiment, in response to determining that the operational mode is changed, the microcontroller 570 sets the operation mode for the secure communication board 500 and the receptacle 599 by specifying the operational mode in a dedicated register or as indicated in a specific section of memory accessible to the secure communication board 500. As above, the operational mode may be selected from the available operational modes, for example, power-only, or power-data modes, dependent upon component states and specified configuration values.

As previously mentioned, the operational mode may be controlled in response to the static (or changing) state of a received control signal from a specific component, for example, a control signal as supplied by the microcontroller 570 or game-logic circuitry 540. In some embodiments, the secure communication board 500 and the receptacle 599 will operate in the specified mode (e.g., default mode or power-data mode) until a state change occurs which requires an operational mode change. For example, state changes that would warrant an immediate operational mode change may include the physical state of one or more physical or electronic security switches, contents of a specific register or memory segment, a specified game event, or a specific condition reported in a received message or command.

In other embodiments, the secure communication board 500 and the receptacle 599 will operate in the specified mode for a specific duration of time, and will then revert to a default mode of operation, if different. This enables the secure communication board 500 to control the amount (and type) of usage that the secure communication board 500 and the receptacle 599 will provide. In one embodiment, specific conditions are required to ensure uninterrupted power supply and/or data flow. An example of such specific conditions may include a wager of a specific size, a credit level maintained above some minimal amount, a rate or amount of wagering in a given period of time, and/or a successful administrative authorization via password or digital device coupling.

Alternatively, the secure communication board 500 and the receptacle 599 may be configured to perform in a particular operational mode for specific a period of time before being completely turned off or defaulting back to another specified operational mode. In some embodiments, the game-logic circuitry 540 is required to periodically provide a command message or control signal to the secure communication board 500 to maintain operation of the secure communication board 500 and the receptacle 599 in a power-data mode. The integration and interaction of the game-logic circuitry 540 and the secure communication board 500 may be achieved in a number of different ways, and does not impart the overall spirit and scope of the present invention.

In step 780, a determination is made, typically during routine operation of the secure communication board 500 and the receptacle 599, whether a command message (e.g., control signal) has been received. Alternatively, this may be a change in state of an actively monitored control signal based upon one or more system components. The command message may be generated by the game-logic circuitry 540 or by a component on the secure communication board 500 in response to a state change or explicit directive, as detailed prior. Once the command message is received, processing of the command message takes place as previously detailed in regard to step 760.

Thus, after any command message is processed, process flow continues with step 770 where the specified mode of operation for the secure communication board 500 and the receptacle 599 is instantiated, and the secure communication board 500 and the receptacle 599 operate in this specified mode until operation ceases or an additional command message is received as determined in step 780.

The provision for the secure communication board 500 to selectively control power and data flow through one or more power and data communication interfaces, including external interfaces, in a variety of modes provides a strong advantage for operation in an EGM and casino gaming machine. Further, connectivity to the EGM itself, internally utilizing established interfaces (e.g., USB), greatly simplifies modification of legacy EGM machines to provide external connectivity, mobile device powering, and wireless communications in a secured, controlled, and dynamic fashion. The use of various components and interfaces on the secure communication board 500 is easily modified, and the use of operational modes and authentication procedures increases security, ease of usage, and overall operation of the EGM in combination with various mobile devices, mobile device types, authentication devices and methods, and tie-ins to wagering games and wagering game events.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system primarily dedicated to playing at least one regulated casino wagering game, the gaming system comprising:

game-logic circuitry; and a gaming machine including a power supply and a mobile device interface coupled to the power supply, the mobile device interface configured to:

couple with a mobile device in proximity to the gaming machine, the mobile device associated with a user of the gaming machine;

selectively provide power to the mobile device based on a power control signal; and selectively provide data communication between the game-logic circuitry and the mobile device based on a data control signal;

wherein the game-logic circuitry is configured to:

initiate the casino wagering game in response to an input indicative of a wager;

determine an outcome of the casino wagering game based, at least in part, on one or more random elements;

in response to a game event occurring in the casino wagering game and satisfying predetermined criteria including at least one of exceeding a predetermined number of initiations of the casino wagering game in a predetermined period of time or exceeding a predetermined amount of wager of the casino wagering game in a predetermined period of time, generate the power control signal;

in response to one or more detected states of the gaming machine satisfying predetermined criteria, generate the data control signal; and grant an award in response to the outcome meeting a predetermined award criterion.

2. The gaming system of claim 1, wherein the game-logic circuitry is further configured to generate the power control signal for a predetermined period of time.

3. The gaming system of claim 1, wherein the mobile device interface couples with the mobile device wirelessly.

4. The gaming system of claim 1, wherein the mobile device interface couples with the mobile device via a universal serial bus (USB) port.

5. The gaming system of claim 1, further comprising a physical security switch coupled to the game-logic circuitry, and wherein the game-logic circuitry is further configured to, in response to the physical security switch being in a closed position, generate the data control signal.

6. The gaming system of claim 1, wherein the game-logic circuitry is further configured to, in response to a successful authentication of the user associated with the mobile device via a non-volatile memory device coupled with the mobile device interface, generate the data control signal.

7. The gaming system of claim 6, wherein the non-volatile memory device contains a digital fingerprint used to authenticate the user associated with the mobile device.

8. The gaming system of claim 7, wherein the game-logic circuitry is further configured to define a plurality of access levels, each of the plurality of access levels corresponding to a particular level of security clearance associated with the digital fingerprint.

9. A casino gaming machine primarily dedicated to playing at least one regulated casino wagering game, comprising:

a power supply;

a mobile device interface coupled to the power supply, the mobile device interface configured to couple with a mobile device in proximity to the gaming machine and selectively provide power to the mobile device in response to a game event occurring in the casino wagering game and satisfying predetermined criteria including at least one of exceeding a predetermined number of initiations of the casino wagering game in a predetermined period of time or exceeding a predetermined amount of wager of the casino wagering game in a predetermined period of time, wherein the mobile device is associated with a user of the gaming machine; and game-logic circuitry configured to:

initiate the casino wagering game in response to an input indicative of a wager;

determine an outcome of the casino wagering game based, at least in part, on one or more random elements;

in response to detecting the game event, provide power from the power supply to the mobile device via the mobile device interface; and grant an award in response to the outcome meeting a predetermined award criterion.

10. The casino gaming machine of claim 9, wherein the game-logic circuitry is further configured to provide power to the mobile device in response to the game event satisfying predetermined criteria for a predetermined period of time.

11. The casino gaming machine of claim 9, wherein the mobile device interface provides power to the mobile device wirelessly.

12. The casino gaming machine of claim 9, wherein the mobile device interface provides power to the mobile device via a universal serial bus (USB) port.

13. A secure communication board coupling to one or more mobile device interfaces and a gaming system performing a wagering game, the secure communication board comprising:

a host interface coupling the secure communication board to the gaming system;

a device interface coupling the secure communication board to the one or more mobile device interfaces configured to communicatively couple to a mobile device associated with a user of the gaming system;

a power switch receiving power from a power supply of the gaming system and receiving a power control signal in response to a game event occurring in the wagering game and satisfying predetermined criteria including at least one of exceeding a predetermined number of initiations of the casino wagering game in a predetermined period of time or exceeding a predetermined amount of wager of the casino wagering game in a predetermined period of time, the power switch configured to selectively provide power to at least one of the one or more mobile device interfaces based on the power control signal; and one or more microcontrollers coupling the host interface to the device interface and receiving a data control signal, the one or more microcontrollers configured to selectively allow data communication between the gaming system and the at least one of the one or more mobile device interfaces based on the data control signal.

14. The secure communication board of claim 13, further coupling to a physical security switch of the gaming system, and in response to detecting the physical security switch in a closed position, generating the data control signal.

15. The secure communication board of claim 14, wherein at least one of the one or more microcontrollers provides only one-way communication from the gaming system to the at least one of the one or more mobile device interfaces based on the data control signal.

16. The secure communication board of claim 14, wherein at least one of the one or more microcontrollers is configured to detect a positional state of the physical security switch as either in an open state or in a closed state, and to block all communication between the gaming system and the at least one of the one or more mobile device interfaces in response to the physical security switch being in an open state.

17. The secure communication board of claim 13, wherein the gaming system generates the data control signal in response to a successful authentication of a user using a digital fingerprint presented via the at least one of the one or more mobile device interfaces.

18. The secure communication board of claim 17, wherein at least one of the one or more microcontrollers provides only one-way communication from the gaming system to the at least one of the one or more mobile device interfaces in response to a successful authentication of a first type of user.

19. The secure communication board of claim 18, wherein at least one of the one or more microcontrollers provides two-way communication between the gaming system and the at least one of the one or more mobile device interfaces in response to a successful authentication of a second type of user.

* * * * *